US010486299B2

(12) United States Patent
Chen

(10) Patent No.: US 10,486,299 B2
(45) Date of Patent: Nov. 26, 2019

(54) SUPPORTER FOR WOODWORKING TABLE

(71) Applicant: YUN KUAN ENTERPRISE CO., LTD., Tongluo Township, Miaoli County (TW)

(72) Inventor: Wen-Che Chen, Tongluo Township, Miaoli County (TW)

(73) Assignee: YUN KUAN ENTERPRISE CO., LTD., Miaoli County (TW)

( * ) Notice: Subject to any disclaimer, the term of this patent is extended or adjusted under 35 U.S.C. 154(b) by 270 days.

(21) Appl. No.: 15/583,430

(22) Filed: May 1, 2017

(65) Prior Publication Data

US 2018/0311809 A1 Nov. 1, 2018

(51) Int. Cl.

| | |
|---|---|
| ***B25H 1/04*** | (2006.01) |
| ***A47B 3/06*** | (2006.01) |
| ***A47B 9/10*** | (2006.01) |
| ***A47B 9/16*** | (2006.01) |
| ***B25H 1/14*** | (2006.01) |
| ***A47B 3/00*** | (2006.01) |

(52) U.S. Cl.

CPC ..... *B25H 1/04* (2013.01); *A47B 3/002* (2013.01); *A47B 3/06* (2013.01); *A47B 9/10* (2013.01); *A47B 9/16* (2013.01); *B25H 1/14* (2013.01); *A47B 2003/006* (2013.01); *A47B 2200/0016* (2013.01)

(58) Field of Classification Search

CPC ..... A47B 2003/006; A47B 2200/0016; A47B 9/16; B25H 1/04; B25H 1/16

See application file for complete search history.

(56) References Cited

U.S. PATENT DOCUMENTS

| | | | | | |
|---|---|---|---|---|---|
| 587,219 | A * | 7/1897 | Maes | F16M 11/00 | 248/150 |
| 1,939,904 | A * | 12/1933 | Koopman | A47B 3/12 | 108/119 |
| 2,829,863 | A * | 4/1958 | Gibson | B25H 1/16 | 108/117 |
| 3,733,623 | A * | 5/1973 | Croxton | A61G 7/012 | 5/611 |
| 5,400,720 | A * | 3/1995 | Stevens | A47B 9/16 | 108/147 |
| 5,833,198 | A * | 11/1998 | Graetz | A47B 9/16 | 248/370 |
| 7,243,896 | B2 * | 7/2007 | Zhang | B25H 1/04 | 248/164 |

(Continued)

*Primary Examiner* — Bradley Duckworth

(57) ABSTRACT

A supporter for a woodworking table contains: four supporting rods, four driving columns, and two movable adjustment posts. Two middle sections of two of the four driving columns are rotatably connected with two middle sections of the other two of the four driving columns respectively, and one side of each of the four supporting rods is in connection with each of two ends of each driving column. The two movable adjustment posts parallelly correspond to each other, and each end of each of the two movable adjustment posts is rotatably connected with a middle section of each supporting rod. Each movable adjustment post includes an outer tube, an inner tube, and an adjustable stem. Thereby, the supporter of the present invention is collapsible so as to decrease its storage size. The supporter adjustably supports the table board based on a size of the table board.

2 Claims, 6 Drawing Sheets

(56) References Cited

U.S. PATENT DOCUMENTS

| | | | | |
|---|---|---|---|---|
| 7,377,504 | B2 * | 5/2008 | Houldsworth | B25B 5/006 248/166 |
| 7,441,760 | B2 * | 10/2008 | Zhang | B25H 1/04 269/130 |
| 7,740,108 | B2 * | 6/2010 | Adkins | B25H 1/04 182/153 |
| D693,614 | S * | 11/2013 | Polidoros | A47B 3/12 D6/708.16 |
| 2010/0147200 | A1 * | 6/2010 | Polidoros | A47B 3/12 108/157.16 |
| 2018/0055214 | A1 * | 3/2018 | Kim | A47B 9/10 |
| 2018/0103752 | A1 * | 4/2018 | Zhong | A47B 3/02 |
| 2018/0255919 | A1 * | 9/2018 | Swartz | A47B 9/02 |
| 2018/0279770 | A1 * | 10/2018 | Crowe | A47B 9/16 |

* cited by examiner

SUPPORTER FOR WOODWORKING TABLE

FIELD OF THE INVENTION

The present invention relates to a supporter for a woodworking table which is collapsible so as to decrease its storage size.

BACKGROUND OF THE INVENTION

Conventional woodworking table is employed to woodwork workpieces thereon, but its size cannot be adjusted based on a size of a table board. In addition, the conventional woodworking table cannot be collapsible so as to decrease its storage size and to be portable easily.

The present invention has arisen to mitigate and/or obviate the afore-described disadvantages.

SUMMARY OF THE INVENTION

The primary objective of the present invention is to provide a supporter for a woodworking table which is collapsible so as to decrease its storage size.

Further objective of the present invention is to provide a supporter for a woodworking table which adjustably supports the table board based on a size of the table board.

Another objective of the present invention is to provide a supporter for a woodworking table of which a height is adjustable by using the two movable adjustment posts.

To obtain the above objectives, a supporter for a woodworking table contains: A supporter for a woodworking table comprising: four supporting rods, four driving columns, and two movable adjustment posts.

The two middle sections of two of the four driving columns are rotatably connected with two middle sections of the other two of the four driving columns respectively, and one side of each of the four supporting rods is in connection with each of two ends of each driving column.

The two movable adjustment posts parallelly correspond to each other, and each end of each of the two movable adjustment posts is rotatably connected with a middle section of each supporting rod.

Each movable adjustment post includes an outer tube, an inner tube, and an adjustable stem; the outer tube movably fits with the inner tube and a first end of the outer tube is rotatably coupled with the two supporting rods. The outer tube has a hollow fixing seat mounted on a second end thereof, an affix piece accommodated in the hollow fixing seat and fitting on an outer wall of the inner tube, and a spring abutting against the affix piece so that the affix piece engages with the inner tube obliquely. The adjustable stem is moved and is fixed on the outer tube parallelly, and one end of the adjustable stem inserts through the hollow fixing seat so as to abut against the affix piece.

Preferably, each supporting rod includes two circular parts and two rectangular parts, wherein the two circular parts are connected with the four driving columns respectively, and the two rectangular parts are rotatably connected with the four driving columns.

DETAILED DESCRIPTION OF THE PREFERRED EMBODIMENTS

Figure 1:
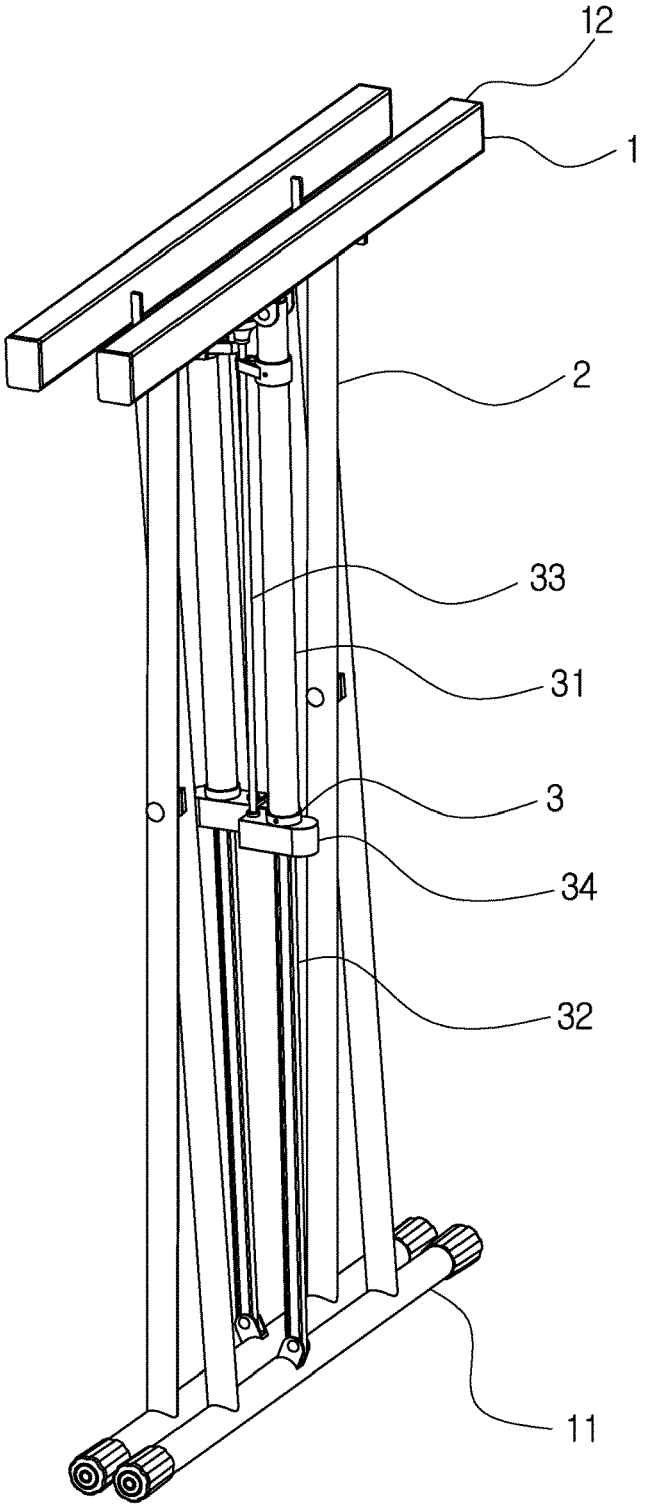
FIG. 1 is a perspective view showing the assembly of a supporter for a woodworking table according to a first embodiment of the present invention.
Figure 2:
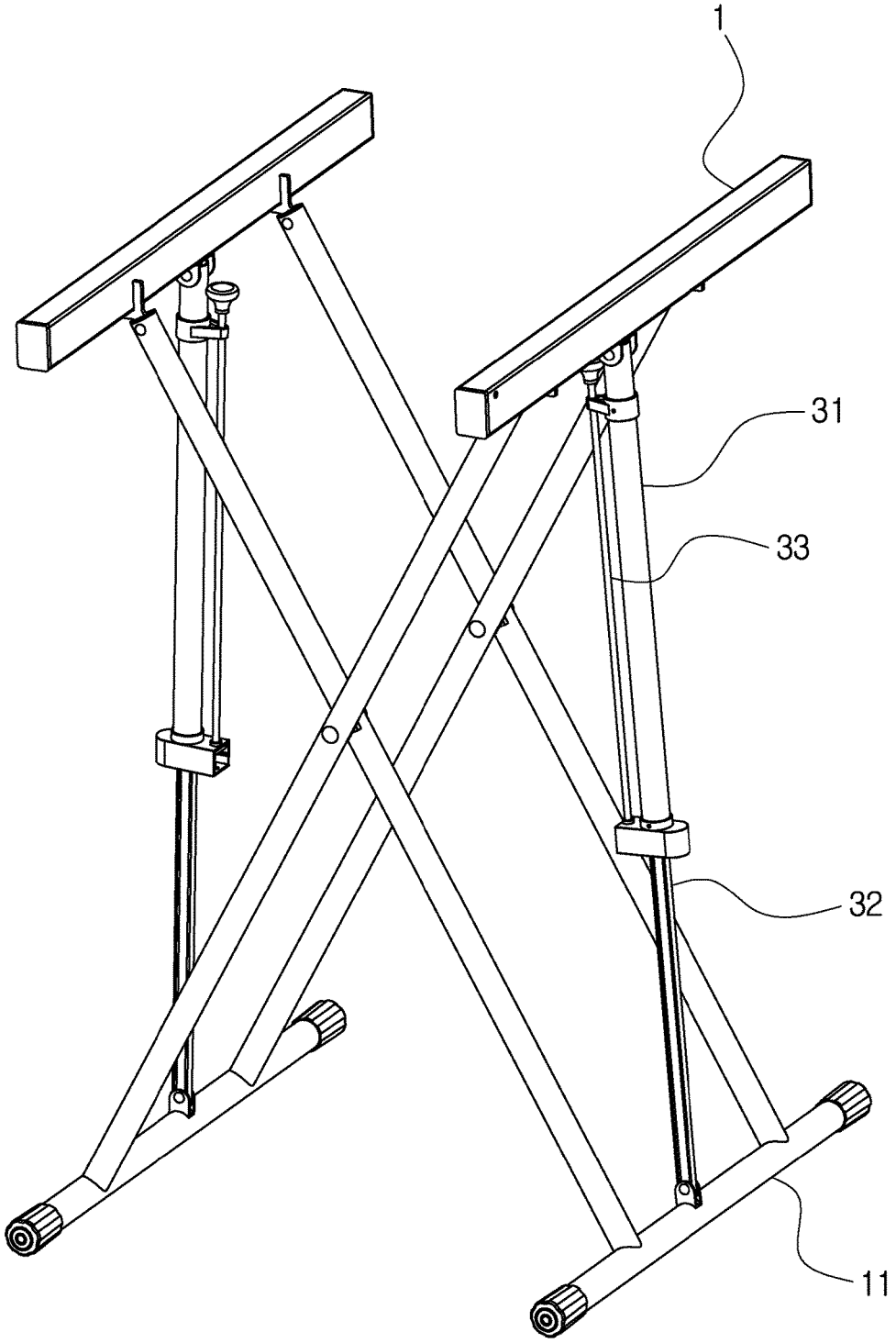
FIG. 2 is another perspective view showing the assembly of the supporter for the woodworking table according to the first embodiment of the present invention.
Figure 3:
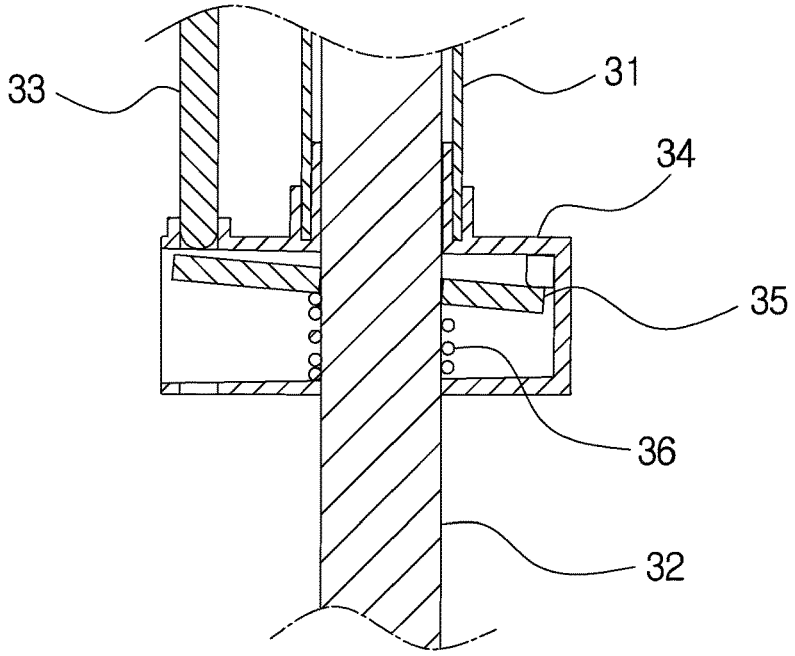
FIG. 3 is a cross sectional view showing the operation of a part of the supporter for the woodworking table according to the first embodiment of the present invention.
Figure 4:
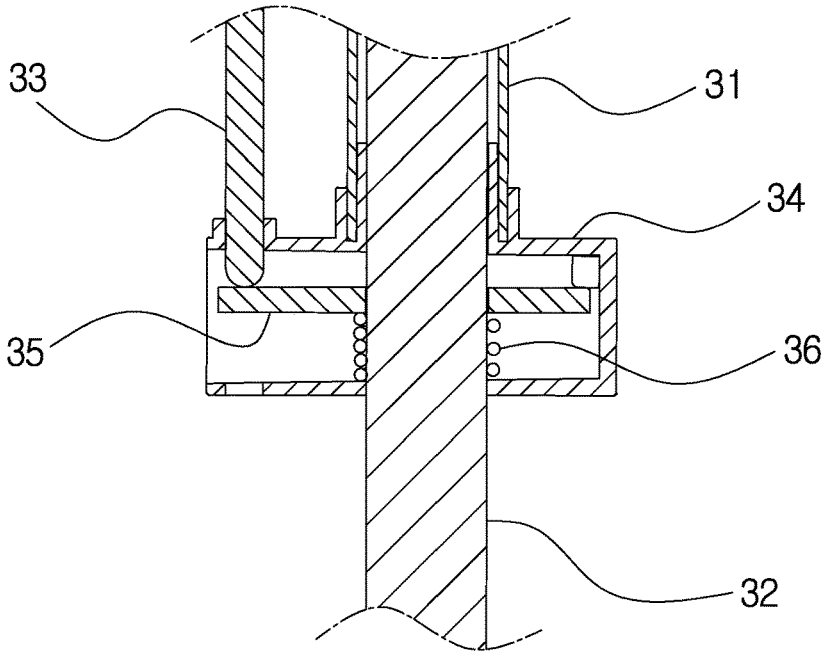
FIG. 4 is another cross sectional view showing the operation of a part of the supporter for the woodworking table according to the first embodiment of the present invention.

With reference to FIGS. 1 to 6, a supporter for a woodworking table according to a first embodiment of the present invention comprises: four supporting rods 1, four driving columns 2 in a circle rod shape, and two movable adjustment posts 3.

Two middle sections of two of the four driving columns 2 are rotatably connected with two middle sections of the other two of the four driving columns 2 respectively, and one side of each of the four supporting rods 1 is in connection with each of two ends of each driving column 2, hence angles between the two driving columns 2 and the other two driving columns 2 are changeable so as to adjust distances between two of the four supporting rods 1.

The two movable adjustment posts 3 parallelly correspond to each other, and each end of each of the two movable adjustment posts 3 is rotatably connected with a middle section of each supporting rod 1, wherein each movable adjustment post 3 includes an outer tube 31, an inner tube 32, and an adjustable stem 33. The outer tube 31 movably fits with the inner tube 32 and a first end of the outer tube 31 is rotatably coupled with the two supporting rods 1. The outer tube 31 has a hollow fixing seat 34 mounted on a second end thereof, an affix piece 35 accommodated in the hollow fixing seat 34 and fitting on an outer wall of the inner tube 32, and a spring 36 abutting against the affix piece 35 so that the affix piece 35 engages with the inner tube 32 obliquely. Preferably, a number of the affix piece 35 is increased according to strength requirement so as to enhance fitting stably of the affix piece 35 and the inner tube 32. The adjustable stem 33 is moved and is fixed on the outer tube 31 parallelly, and one end of the adjustable stem 33 inserts through the hollow fixing seat 34 so as to abut against the affix piece 35.

Thereby, when the adjustable stem 33 is moved, the affix piece 35 is pushed by the adjustable stem 33 to disengage from the inner tube 32, and the outer tube 31 removes from the inner tube 31, thus adjusting the distances between the two supporting rods 1, changing the angles between the two driving columns 2 and the other two driving columns 2, and adjusting length of each movable adjustment post 3. After the two supporting rods 1 is connected with a table board, each movable adjustment post 3 is released so that the spring 36 abuts against the affix piece 35.

Figure 5:
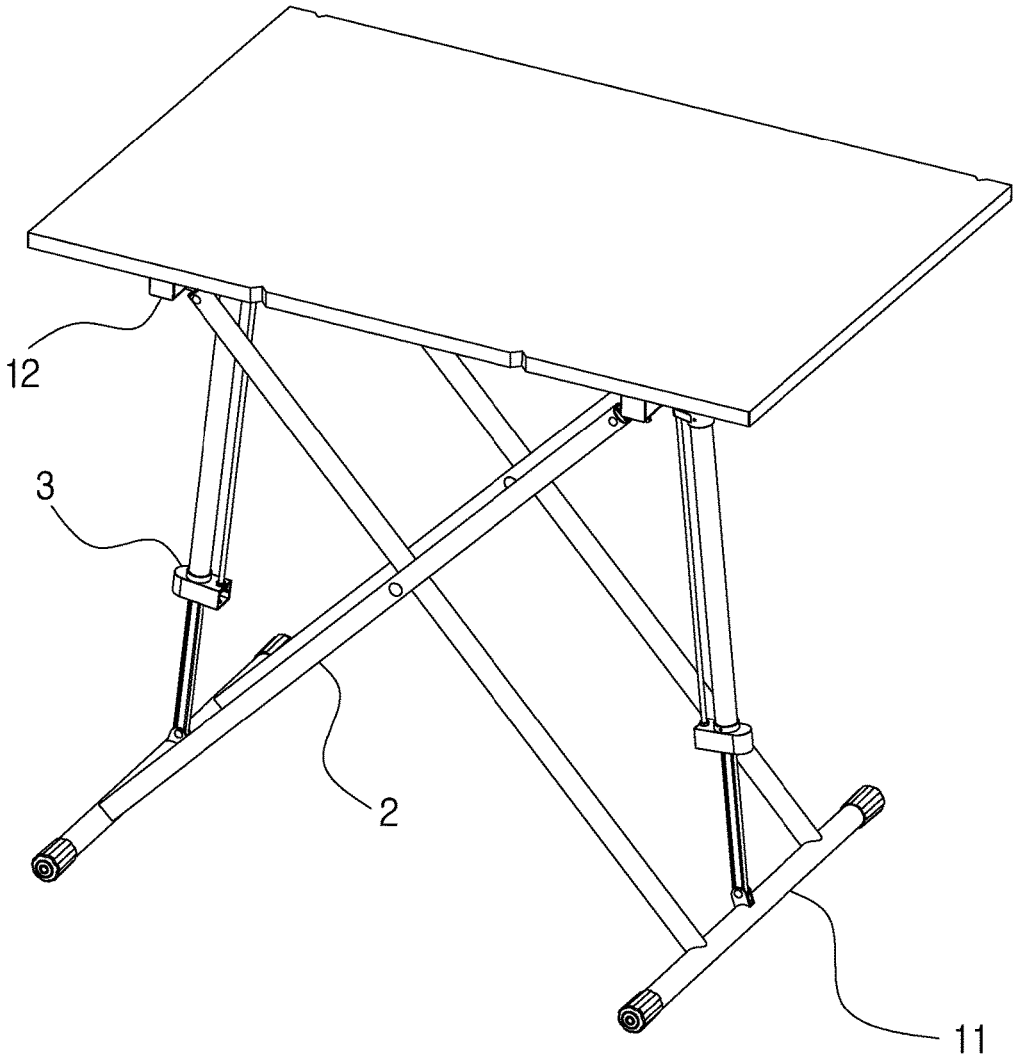
FIG. 5 is a perspective view showing the assembly of the application of the supporter for the woodworking table according to the first embodiment of the present invention.
Figure 6:
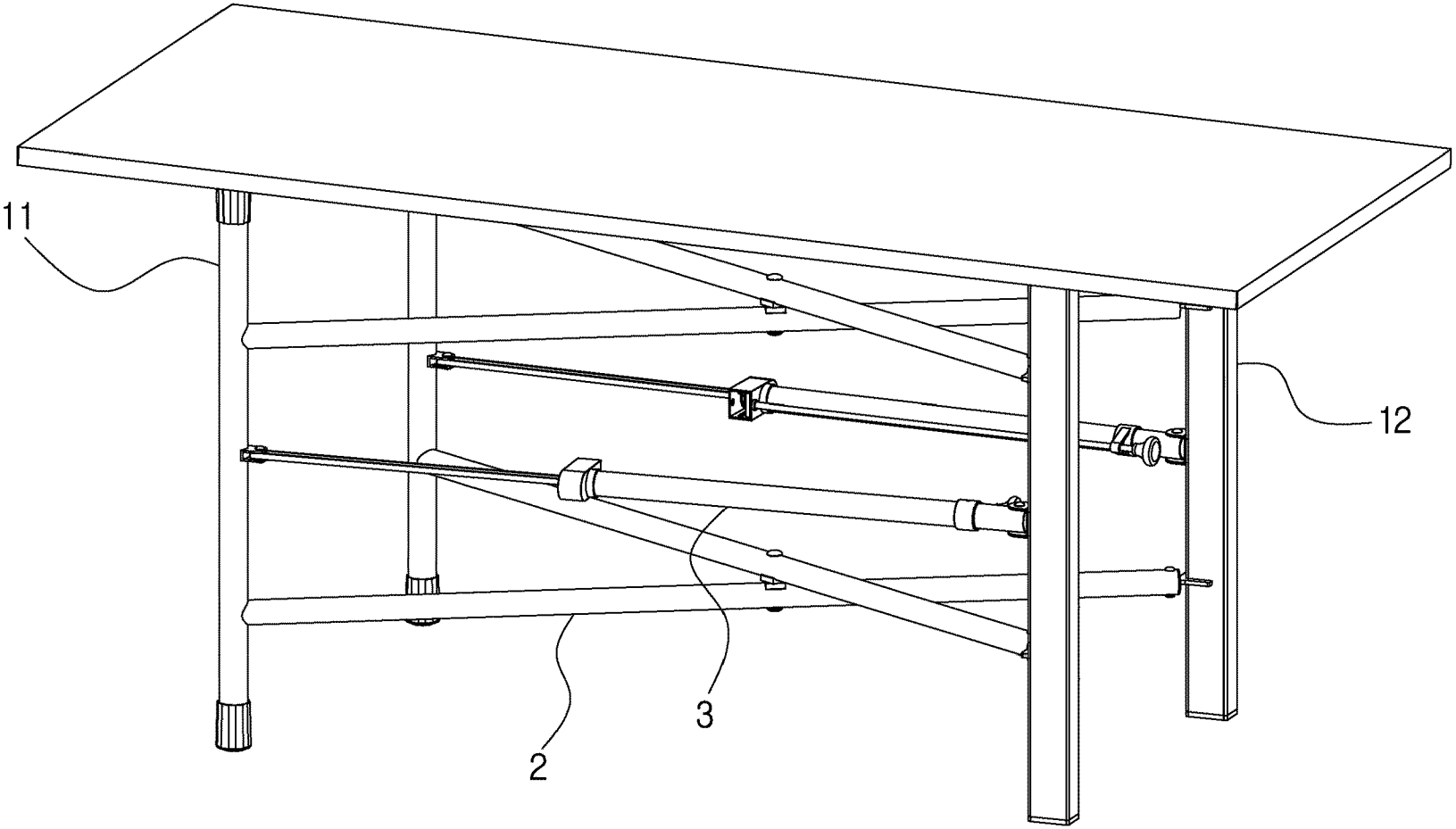
FIG. 6 is a perspective view showing the application of a supporter for the woodworking table according to a second embodiment of the present invention.

Each supporting rod 1 includes two circular parts 11 and two rectangular parts 12, wherein the two circular parts 11 are connected with the four driving columns 2 respectively, and the two rectangular parts 12 are rotatably connected with the four driving columns 2, hence as the supporter is expanded, the two rectangular parts 12 support the table board stably, as shown in FIG. 5.

Figure 7:
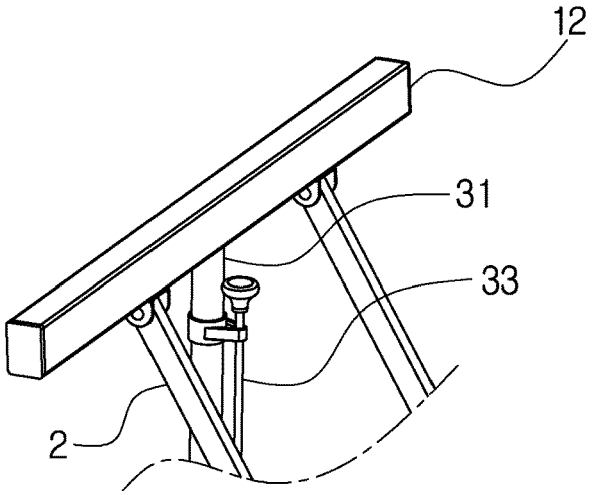
FIG. 7 is a perspective view showing the application of a part of the supporter for the woodworking table according to the second embodiment of the present invention.

Referring to FIG. 7, a difference of a supporter for a woodworking table of a second embodiment from that of the first embodiment comprises: four driving columns 2 in a square rod shape and two movable adjustment posts 3, wherein each of the two movable adjustment posts 3 includes an outer tube 31 connected with each of two rectangular parts 12.

Figure 8:
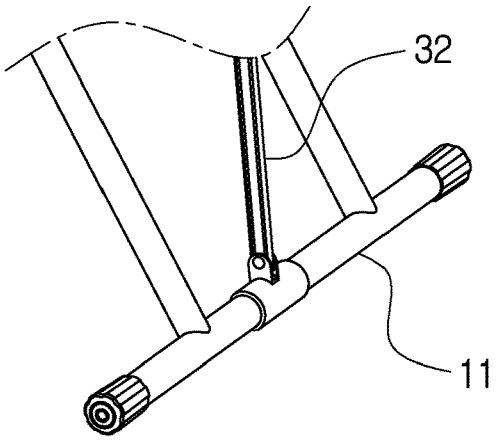
FIG. 8 is a perspective view showing the application of a part of a supporter for the woodworking table according to a third embodiment of the present invention.

As shown in FIG. 8, in a third embodiment, the inner tube 32 is rotatably connected with each of two circular parts 11 by way of a fitting sleeve.

Accordingly, the supporter of the present invention is collapsible so as to decrease its storage size. The supporter adjustably supports the table board based on a size of the table board. Preferably, a height of the supporter is adjustable by using the two movable adjustment posts.

While the preferred embodiments of the invention have been set forth for the purpose of disclosure, modifications of the disclosed embodiments of the invention and other embodiments thereof may occur to those skilled in the art. Accordingly, the appended claims are intended to cover all embodiments which do not depart from the spirit and scope of the invention.

What is claimed is:

1. A supporter for a woodworking table comprising:

four supporting rods, four driving columns, and two movable adjustment posts;

wherein a middle section of each driving column is rotatably connected to a middle section of another one of the driving columns, and one end of each of the four supporting rods is connected to one end of a respective one of the driving columns;

the two movable adjustment posts are arranged in parallel with each other, and one end of each of the two movable adjustment posts is rotatably connected to a middle section of a respective one of the supporting rods;

each movable adjustment post includes an outer tube, an inner tube, and an adjusting stem, each inner tube movably disposed at least partially within the respective outer tube, and a first end of each outer tube is rotatably coupled to a respective one of the supporting rods;

each outer tube has a hollow fixing seat mounted on a second end thereof, a respective affixing piece accommodated in each hollow fixing seat and engaging an outer wall of the respective inner tube, and a respective spring abutting against each affixing piece so that the affixing piece is biased to engage with the respective inner tube obliquely; and each adjusting stem is movably fixed on the respective outer tube and in parallel with the respective outer tube, and one end of each adjusting stem is inserted through the hollow fixing seat of the respective outer tube so as to abut against the respective affixing piece.

2. The supporter as claimed in claim 1, wherein the supporting rods comprise two circular parts and two rectangular parts, wherein the two rectangular parts are rotatably connected with the four driving columns.

* * * * *